US005784746A

United States Patent [19]

Williams et al.

[11] Patent Number: 5,784,746

[45] Date of Patent: Jul. 28, 1998

[54] ABRASIVE MOP HEAD

[75] Inventors: Todd A. Williams, Aliso Viejo; Richard A. Williams, Dana Point, both of Calif.

[73] Assignee: Economics in Technology, Costa Mesa, Calif.

[21] Appl. No.: 638,840

[22] Filed: Apr. 29, 1996

Related U.S. Application Data

[63] Continuation-in-part of Ser. No. 608,092, Feb. 28, 1996, abandoned, which is a continuation-in-part of Ser. No. 334,203, Nov. 4, 1994, abandoned.

[51] Int. Cl.[6] ..... A47L 13/12

[52] U.S. Cl. ..... 15/118; 15/229.2

[58] Field of Search ..... 15/118, 228, 229.1–229.9, 15/229.11

[56] References Cited

U.S. PATENT DOCUMENTS

| | | | |
|---|---|---|---|
| 1,643,857 | 9/1927 | Sacks | 15/118 |
| 1,643,878 | 9/1927 | Crouch | 15/228 |
| 2,482,163 | 9/1949 | Finnell | 15/118 X |
| 2,683,886 | 7/1954 | Neumann | 15/118 X |
| 2,825,914 | 3/1958 | Moss | 15/118 X |
| 3,205,519 | 9/1965 | Nowlin et al. | 15/118 |
| 3,246,356 | 4/1966 | Sorrells | 15/118 |
| 3,384,918 | 5/1968 | Fink | 15/118 X |
| 3,399,499 | 9/1968 | Stetz et al. | 15/118 X |
| 3,432,873 | 3/1969 | Moss | 15/118 |
| 3,501,796 | 3/1970 | Moss | 15/118 |
| 3,528,076 | 9/1970 | Anderson | 15/228 |
| 3,750,218 | 8/1973 | Rosocha | 15/118 |
| 3,795,934 | 3/1974 | Moss | 15/118 X |
| 4,085,476 | 4/1978 | Moss | 15/118 X |
| 4,306,326 | 12/1981 | Kim | 15/118 X |
| 4,675,932 | 6/1987 | Hofacker, Jr. | 15/118 |
| 4,843,674 | 7/1989 | Jones | 15/147.1 |
| 4,852,210 | 8/1989 | Krajicek | 15/228 |
| 4,964,186 | 10/1990 | Stuck | 15/118 |
| 5,080,517 | 1/1992 | Lynn | 401/13 |

OTHER PUBLICATIONS

Photographs of a mop head having an abrasive pad attached at the handle attachment portion, 1994.

Photographs of a Quickie™ mop head from Quickie Manufacturing Corporation, 1994.

*Primary Examiner*—Mark Spisich

*Attorney, Agent, or Firm*—Knobbe, Martens, Olson & Bear, LLP

[57] ABSTRACT

A mop head comprising a plurality of absorbent strands and an abrasive pad located close to a first ends of the strands may be used in a conventional manner to perform abrasive point load mopping. In a method of abrasive point load mopping, the abrasive pad mechanically breaks up surface contaminants that have accumulated on a kitchen floor without substrate surface deterioration. No special skills, special cleaning solutions or special equipment are required in order to effectively improve the floor's coefficient of friction and thereby reduce the risk of injuries from slips and falls. In one preferred embodiment, the mop head also includes a second abrasive pad located at the mop handle attachment, intermediate the first abrasive pad and the handle.

17 Claims, 7 Drawing Sheets

30
48
32
54
62
42
50
46
52
64
60
58
56

44
54
42
46
48
52
32
66
62
50

44
48
66

44
42
46
66

48
32
54
62
50
46
72
52
68
70
72

ABRASIVE MOP HEAD

RELATED APPLICATIONS

This application is a continuation in part of application Ser. No. 08/608,092, filed Feb. 28, 1996, now abandoned which is a continuation in part of application Ser. No. 08/334,203, filed Nov. 4, 1994 now abandoned.

FIELD OF THE INVENTION

The present invention relates generally to the field of mop heads, and, in particular, to a mop head and method of mopping which mechanically breaks up grease and other residue such that an in-place floor achieves its full potential coefficient of friction, thereby reducing the likelihood of injuries from slips and falls.

BACKGROUND OF THE INVENTION

Floors, both at home and especially in food service or restaurant operations, are prime arenas for injuries resulting from slips and falls. Injuries are often sustained during the fall to the ground, such as hitting the head or arm on a counter on the way down. In addition, the act of slipping, and not necessarily falling completely to the ground, can have dangerous consequences, such as if a heavy tray was dropped on a foot or a hand was accidentally placed on a hot grill.

In a recent article it was reported that in a 12 month period approximately 12 million injuries occurred in falls which required at least one day of restricted activity or medical attention. The combination of home and public falls accounts for approximately 27% of all accidental injuries. The National Safety Council has reported that in one year nearly 11,000 deaths resulted from falls, second only to automobile accidents. Annually in the food service industry alone, an estimated $500 million is paid to claimants either in the form of awards or out of court settlements. Thus, there is a very large monetary incentive to reduce injuries from slips and falls, including insurance costs and claim settlements.

Four contributors to slips and falls have been noted: 1) the floor surface coefficient of friction (COF), 2) the footwear COF, 3) the presence of surface contaminants, and 4) the walking behavior of users. While all four factors are controllable to some degree, the floor surface COF and surface contaminants are most readily monitored and controlled.

In a restaurant, both the employees and the guests are susceptible to potential harm if steps are not taken to ensure safety. While a soft, carpeted area would help in the event of a fall, most restaurant kitchens utilize hard tile floors. That is because tile is more economical in the long run and requires simpler maintenance. In fact, many restaurant kitchens utilize grouted quarry tile.

The coefficient of friction is generally defined as the amount of force parallel to a surface that is required to move or make slip a force or weight that is normal to the surface, divided by the weight. Thus, floors having a higher COF, or rougher surface texture, are desirable in kitchens. Floors among the worst for COF values are terrazzo and marble floors, although some ceramic tile floors are as bad.

In order to increase safety, restaurants rely heavily on keeping the tile floors clean and non-slippery in order to reduce accidents and injuries. A new quarry tile floor typically has a non-smooth, shoe-gripping surface of peaks and valleys, and also has a surface pore structure designed to reduce the possibility of slips and falls. Other floors have patterned tiles to provide a non-slip surface. The fats and oils that fall on the floor, or are tracked by shoes over the course of time, accumulate on the floor and combine with the cleaning solutions to fill in valleys in the floor and the surface area pore structure. Thus, the COF of the floor is reduced over time and the floor becomes slippery and dangerous.

The surface contaminants in the typical restaurant floor include the fats and oils, or grease, which polymerize to compounds which are hard and dense, and difficult to remove. The polymerized grease alone can account for a 50% reduction in the floor COF. Grout joint saponification also occurs, wherein the grout material becomes another slippery residue. The cleaning solutions which are used are usually detergents that are emulsifiers, and typically alkaline. Therefore the so-called soap scum that results can be additional residue contaminating the floor surface. Also, mineral deposits can form on the floor from both the use of hard water and the formulation of the detergent that is used. Some other detergents are not desirable because of their toxicity.

Thus, as far as eliminating surface contaminants, the choice of cleaning method is important. There are various cleaning methods, but most do not dislodge the grease or remove it. The most effective method is the use of an extractor, which is a combination of a sprayer and vacuum. While a single pass of the extractor is usually adequate, the system is relatively expensive and requires expertise to use. Another method is the use of a rotary scrubber and wet vac (vacuum), although this requires two passes to complete. Other methods include deck brushing with squeegeeing and rinsing, use of a pressure washer and hose rinse, and a simple hose down of the floor. However, except for the hose down, all of these methods require greater than average cleaning expertise and require equipment costing much more than a mop bucket. A hose down, meanwhile, may be undesirable for certain areas and is simply not effective in removing polymerized grease and other contaminants. Moreover, although deck brushing is recommended by many employers, employees in practice, simply do not take the extra time needed to completely deck brush the floor. In most instances, deck brushing occurs rarely, if at all.

Conventional mopping is popularly used in kitchens for cleaning. A mop, bucket and water with chemical cleaning solution are the only components required. A pivotal motion is generally used for the mop head over the floor surface, which can be performed by an employee after minimal, if any, training. The mop heads can be composed of a sponge or long strands of loose or looped material. The mop heads can additionally include a scuff or scouring pad that is attached at the bail and shoe of the handle attachment in order to facilitate scrubbing for spot removal of stains. In one prior art mop described in U.S. Pat. No. 3,750,218 to Rosocha, a scuff pad is attached to an S-shaped plate that is clamped to the handle. In all of these prior art mop heads, the scuff pad is rigidly attached to the handle either directly or indirectly, so as to facilitate a scrubbing motion through application of a force on the mop handle. In certain of these mop heads, a scuff pad is sewn to a mop head attachment region at one end, and the other end of the pad extends as far as 3½ inches from the mop head attachment region so that the handle can be placed over the pad for scrubbing.

SUMMARY OF THE INVENTION

One aspect of the present invention relates to a mop head that removes grease load and increases the coefficient of friction of a floor. The mop head has a plurality of elongated strands of absorbent material having a first plurality of free ends and a second plurality of free ends, a mop handle attachment region located intermediate the first plurality of free ends and the second plurality of free ends and an abrasive pad attached to the elongated strands intermediate the first plurality of free ends and the mop handle attachment region. The mop handle attachment region is adapted to attach to a mop handle. In one embodiment the pad has a distal end closer to the first plurality of free ends and a proximal end closer to the mop handle attachment region. In this embodiment, the distal end is positioned in the range from approximately one-tenth the distance between the first plurality of free ends and the mop handle attachment region and two-thirds the distance between the first plurality of free ends and the mop handle attachment region. The mop head can also include at least one band for fastening the plurality of elongated strands of absorbent material together. Preferably, there are at least three bands, as follows: a central band at the mop handle attachment region, a first end band located between the mop handle attachment region and the first plurality of free ends, and a second end band located between the mop handle attachment region and the second plurality of free ends. The pad of the mop head can have a distal end closer to the first plurality of free ends and a proximal end closer to the mop handle attachment region. The distal end of the pad can be attached to the plurality of elongated strands of absorbent material by the first end band. A third end band intermediate the first end band and the central band can also be included, wherein the proximal end of the abrasive pad is attached to the plurality of elongated strands of absorbent material by the third end band. The band can be formed of a strip of absorbent material stitched onto the plurality of elongated strands of absorbent material, and preferably the strips of absorbent material extend laterally across at least one side of the plurality of elongated strands of absorbent material. The abrasive pad is preferably comprised of a non-absorbent material, which can also be porous. Two or more abrasive pads can also be attached. In a preferred embodiment, the abrasive pad extends laterally across all of the plurality of strands. The abrasive pad can be of any shape, such as rectangular or square.

Another aspect of the invention relates to a mop head for abrasive point load mopping of a floor. In this aspect, the mop head includes a plurality of elongated strands of absorbent material having a plurality of free ends, a mop handle attachment region on the strands, a first abrasive pad attached to the elongated strands intermediate the plurality of free ends and the mop handle attachment region, and a second abrasive pad attached to the strands at the mop handle attachment region.

Yet another aspect of the invention relates to an abrasive mop head for cleaning a floor wherein the mop head comprises a plurality of elongated strands of absorbent material having a first and second plurality of free ends, a mop handle attachment region intermediate the free ends, and at least one abrasive pad attached to the strands. The pad has distal and proximal ends, with the distal end closer to the first plurality of free ends than to the second plurality of free ends, and the distal end extending at least one-third the distance from the handle attachment region to the first plurality of free ends. The distal end of the abrasive pad can extend approximately three-fourths the distance from the handle attachment region to the first plurality of free ends. The abrasive pad can extend into the mop handle attachment region. In a preferred embodiment, a second abrasive pad having a distal and a proximal end is attached to the strands such that the first and second pads are simultaneously applied to the floor with the strands, and the first and second abrasive pads are in continuous contact with the floor during each mopping stroke. The first pad is preferably unattached along its proximal end, and the second pad is preferably unattached along its distal end.

Yet another aspect of the present invention relates to a method of abrasive point load mopping of a floor having contaminants present thereon. The method includes the steps of: (a) wetting a mop head with cleaning solution, the mop head having a plurality of elongated strands of absorbent material and an abrasive pad attached closer to the free ends of the strands than to a handle attached to the mop head, and (b) simultaneously applying the wetted elongated strands and the abrasive pad to the floor wherein the pad is in continuous contact with the floor, thereby breaking up the contaminants present on the surface of the floor. Step (b) may comprise applying a first side of the mop having the abrasive pad attached thereto, wherein a subsequent step of applying the elongated strands to the floor to wipe up the broken up contaminants comprises applying a second side of the mop. Steps (a) and (b) can be done with the mop head having a second abrasive pad attached at the mop handle on the same side as the first abrasive pad. The method can also include rinsing the mop head in cleaning solution and squeezing out the contaminants wiped up by the elongated strands. The step of placing an end of a mop handle over the abrasive pad to increase pressure thereon and scrubbing a stain on the floor can also be performed.

Still one more aspect of the present invention relates to a mop head that removes grease load and increases the coefficient of friction of a dirty floor by abrasive point load mopping. This aspect includes a plurality of elongated strands of absorbent material having a first plurality of free ends and a second plurality of free ends, a mop head attachment region located intermediate the first plurality of free ends and the second plurality of free ends, and an abrasive pad having a distal end and a proximal end. The mop head attachment region is adapted to attach to a mop handle. The proximal end of the pad is attached to the mop head attachment region, and the distal end of the pad extends at least 3½ inches from the mop head attachment region, more preferably, 4, 5, 6, 7, 8, 9 or 12 inches from the mop head attachment region. The pad can even extend all the way to either the first or second plurality of free ends of the strands. The distal end need not be attached to the strands. The proximal end can be sewn to the mop head attachment region. In a preferred embodiment, the abrasive pad is comprised of a non-absorbent and/or porous material. The pad can extend laterally across all of the strands and can be rectangular. In one embodiment, the abrasive pad is between 6 and 9 inches wide.

Further advantages and applications will become apparent to those skilled in the art from the following detailed description and the drawings referenced herein.

DETAILED DESCRIPTION OF THE PREFERRED EMBODIMENTS INTRODUCTION

Figure 1:
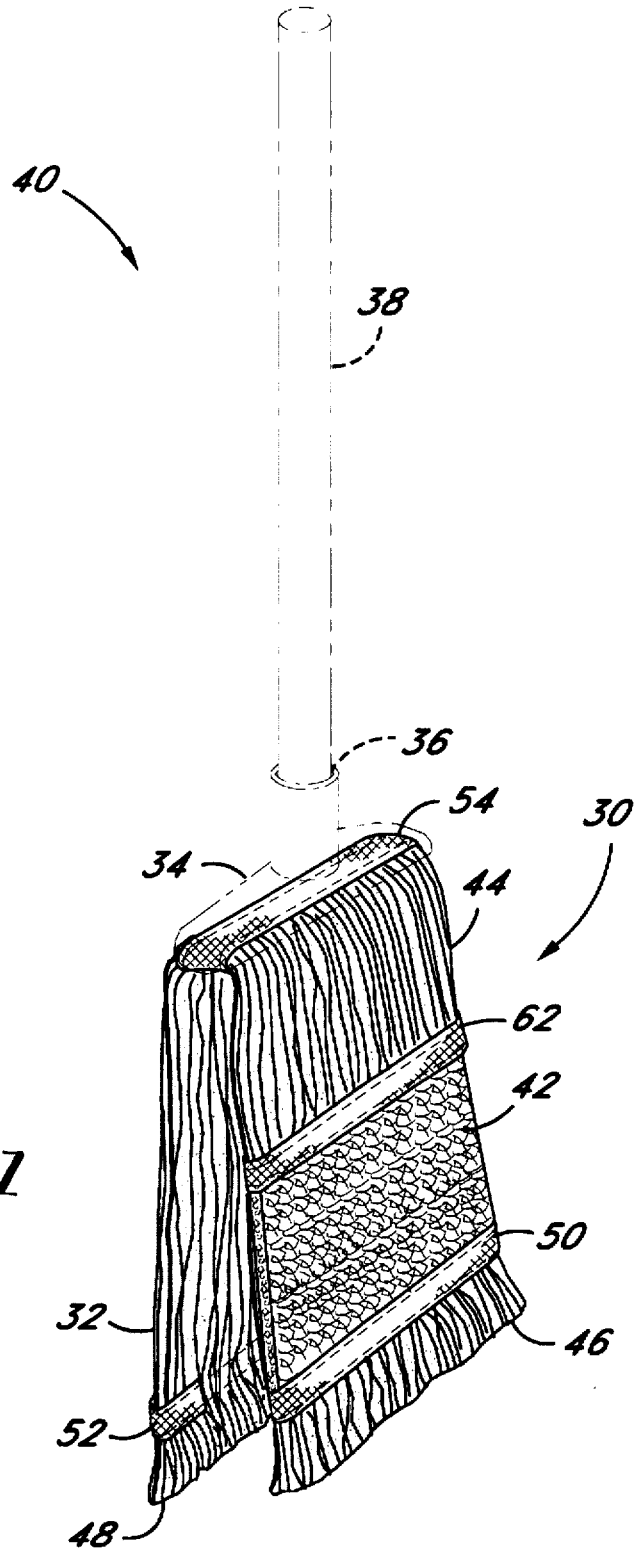
FIG. 1 is a perspective view of the preferred embodiment of the present invention, illustrating an abrasive pad attached close to the end of a top, outer-facing side of the mop head, with a mop handle attachment shown in phantom.

The mop strands alone of prior art mop heads are insufficient to break up most surface contaminants. Prior art mop heads which do not utilize a scuff pad are heavily dependent upon the cleaning solution to chemically decompose the contaminants. However, as noted above, cleaning solutions alone are largely ineffective. Scuff pads on mops are typically stiff members which are not readily applied in the normal mopping motion and are subject to tearing. In addition, most scuff pads are small in size compared to typical mop heads with strands, and therefore a smaller area is coverable in each stroke. Thus, overall, present mop heads are not adequate to remove surface contaminants, as described hereinabove in the Background of the Invention. In particular, the mop heads described therein which have a scuff pad sewn at the mop head attachment region at a proximal end, wherein the distal end of the pad extends as far as 3½ inches from the mop head attachment region are inadequate for the purposes described herein in connection with the present invention. In addition to providing less than ideal surface area, the pads in such mop heads are folded over during normal use so that most of the pad does not contact the surface being mopped. Thus, with these mop heads, the user must specifically catch the distal end of the pad onto the floor in order to have the pad unfolded for contact onto the floor when scrubbing is desired.

The mop head of the present invention overcomes the aforenoted problems and disadvantages by mechanically breaking up the polymerized bonds of the grease through the use of an abrasive pad mounted near the free ends of the strands of absorbent material, thereby allowing traditional mopping motion to remove the broken up surface contaminants without substrate surface deterioration. Through "abrasive point load mopping" and the combination of the strands of material with the abrasive pad, the coefficient of friction for any given floor is increased. That is, the dirty, sealed-off, planar surface is returned to a rougher texture with increased peaks and valleys, and pore structure of the original clean floor.

We have surprisingly invented a mop head that can simultaneously break up surface contaminants and provide for their removal from the floor. Thus, the present invention advantageously combines the action of a mop and a deck brush, thereby eliminating the need for conducting both of these steps.

In a first preferred embodiment, the mop head of the present invention includes a rectangular pad of non-absorbent material which is attached to an outer side of the mop head. The other outer side resembles a conventional mop head. The abrasive pad is mounted to be closer to the free ends of the strands of material than the handle attachment. The size and placement of the pad is such as to allow conventional, pivotal mopping motion and rinsing in a bucket. Thus, no special skills or equipment are required by the user.

In another preferred embodiment, a second abrasive pad is attached to the other outer side of the mop head which in the first embodiment comprised only the strands of material. Thus, the two sides of the mop head are identical, and the abrasive pads are both mounted nearer the free ends than the handle attachment. Conventional mopping strokes are still readily performed with the two pads attached to the mop head of this embodiment.

Yet another preferred embodiment comprises a first abrasive pad attached near the free ends and another abrasive pad attached between the first abrasive pad and the handle attachment. These two pads are located on the same outer side of the mop head and provide a greater abrasive point load mopping capability than the aforementioned embodiments. That is, each mopping stroke provides a more aggressive application of the abrasive pads to the floor.

In a preferred use, the mop head is first wetted in a cleaning solution, then the side with the abrasive pad(s) is applied to the dirty floor in a usual pivotal motion. Next, the other side of the mop head, without the abrasive pad(s), is applied to the floor to remove the broken up contaminants. The mop may then be rinsed in a traditional mop bucket, and is ready for another application. For stains or heavier soil loads, the mop handle may be placed over the abrasive pad when it is applied to the floor, so that the added pressure can scrub the stain for removal.

Thus, the mop head of the present invention allows any choice of cleaning solution to be used with a traditional mopping procedure without requiring special skills or equipment. The present invention provides aggressive surface agitation in its "specific use cleaning" of ceramic or cementitious hard surface tiles or concrete surfaces, such as walkways or patterned traffic areas. The surface contaminants are mechanically broken up for easy removal by the mop head, thereby exposing once more the peaks and valleys, as well as the pore structure, of the surface, and the coefficient of friction of the floor is substantially restored without harm to the floor material.

Preferred Embodiments

A first preferred embodiment of the mop head of the present invention is illustrated in FIG. 1, and generally referenced by the numeral 30. In this embodiment, the mop head 30 comprises a plurality of elongated strands 32 of absorbent material, such as a rayon and cotton blend. A bail and shoe arrangement 34 may be utilized for securing an end 36 of a handle 38 to the mop head 30, as illustrated in phantom, to complete a mop 40. Although, the abrasive mop head of the present invention may be secured to the handle with any attachment device known to those skilled in the art.

In the preferred embodiment of FIG. 1 an abrasive pad 42 of porous, nonabsorbent material is attached on a top, outer-facing side 44 of the mop head 30, to provide the aggressively abrasive, specific use cleaning of the floor surface contaminants. The pad 42 need not be porous, as long as it provides a sufficient level of abrasion to remove surface contaminants without the application of excessive force. Of course, the pad 42 can be attached to any side of the mop head 30, which then becomes the outer-facing side 44. A pad 42 can also be attached to more than one side, as in a second embodiment 80 described herein in reference to FIG. 12, or a large pad can extend around to cover more than one side. The placement of the abrasive pad 42 closer to first and second free ends 46 and 48, respectively, of the plurality of strands 32 than to the handle attachment 34 allows the pad 42 to freely move with the strands 32 in each circular mopping motion on the floor surface. The abrasive pad 42 is very effective in mechanically breaking up the contaminants that include fats, oils, and cleaning chemical residue. Thus, the COF of the floor is substantially improved as the peaks and valleys and more of the pore structure of the floor's original texture are again exposed to provide a more non-slip surface.

Figure 13:
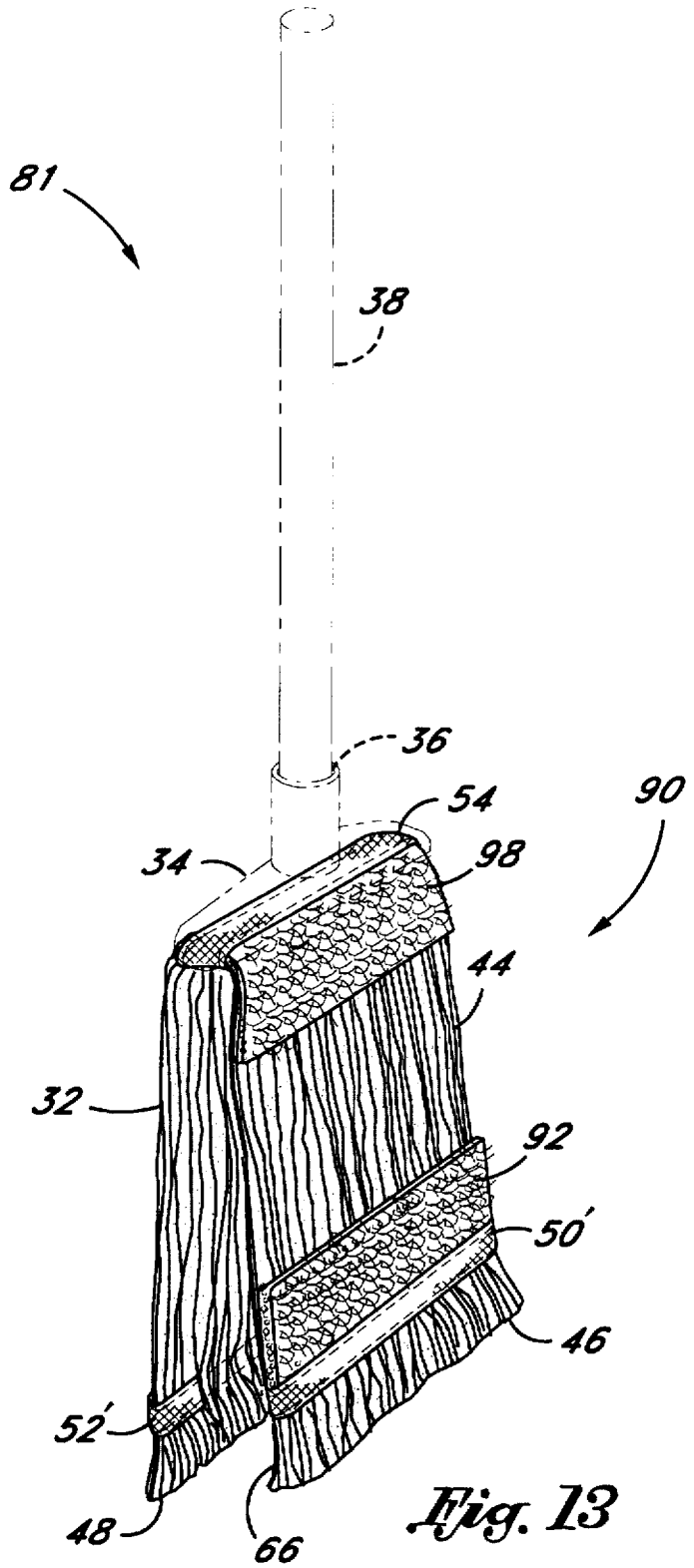
FIG. 13 is a perspective view of yet another preferred embodiment of the present invention, illustrating abrasive pads attached close to the ends of a top, outer-facing side of the mop head, with a mop handle attachment shown in phantom.

Enhanced abrasion is provided in a third embodiment of the mop head of the present invention, illustrated in FIG. 13 and generally referenced by the numeral 90. In the preferred embodiment of FIG. 13, a first abrasive pad 92 similar to the abrasive pad 42 of FIG. 1 is attached along its distal end to an outer facing side of the mop head 90, nearer the first plurality of free ends 46 than to the handle 38. A second abrasive pad 98 is attached along its proximal end intermediate the first abrasive pad 92 and the handle 38. The first and second abrasive pads 92, 98 are located on the same outer facing side of the mop head 90 and continuous abrasive contact with the floor during the mopping action is obtained. In each of the above embodiments, a conventional handle attachment, such as a bail and shoe or other plastic device, may be utilized.

Coefficients of Friction

As shown below in TABLE 1, new, clean, dry quarry tile has a COF within the range 0.70 to 0.85. However, various contaminants on the quarry tile significantly lower its COF. For example, in conventional restaurant operations polymerization occurs through mopping of the floor with conventional chemical cleaning solutions. Complete polymerization of a completely clean floor will occur within three to four weeks using conventional mopping. With water or grease, in addition to the polymeric coat, the COF is reduced still further. TABLE 1 provides examples of the COF values for quarry tile under various conditions.

TABLE 1

Examples of Floor Coefficients of Friction

| FLOOR MATERIAL | COF |
|---|---|
| New, clean, dry quarry tile | .70–.85 |
| Dry polymeric coated quarry tile | .45–.55 |
| Wet, polymeric coated quarry tile | .30–.35 |
| Greasy, polymeric coated quarry tile | .15–.25 |
| Wet, Greasy, Polymeric-Coated Quarry Tile | .05–.15 |

It can be seen that the worst case condition of a greasy, wet, polymeric-coated quarry tile leads to such a low COF of 0.05 to 0.15, that falling becomes highly likely. Thus, efforts to maintain the quarry tile free of surface contaminants are critical to ensure safety.

The hard grease film which forms after several weeks of conventional floor care is the primary cause of the slip and fall problem. This film can only be removed by vigorous mechanical scrubbing or through any of various harsh chemical processes. However, heretofore mechanical scrubbing has involved significant additional labor time. Moreover, the chemical processes are expensive and tend to be injurious themselves through skin contact or through breathing their fumes or vapors.

Several new detergents are being sold that claim to produce "slip-resistant" results on restaurant floor surfaces. However, in order to maintain the COF of a floor using such products, it is necessary to scrub the floor briskly with a deck brush and 160° F. (67° C.) water to break up hard film and remove contaminants with a wet vac or squeegee before thoroughly rinsing. Thus, even with these new detergents, the polymerized bond must be mechanically disturbed or broken. None of these detergents can produce successful results using ordinary mopping methods.

In contrast to prior art methods of breaking up the hard grease film which results in decreased COF, the present invention mechanically disrupts contaminants through "abrasive point load mopping." The result of the present invention is a clean floor without use of additional steps such as deck brushing or squeegeeing, and without use of cumbersome and expensive equipment, such as high pressure hoses or wet vacs.

Preferred Constructions

Referring once more to FIG. 1, it can be seen that the plurality of strands 32 of the preferred embodiment are held together near their free ends 46, 48 using strips of absorbent material forming end bands 50, 52 which are stitched laterally across the strands 32. For more different customer needs, mop heads including a variety of types of absorbent strands may be utilized with the present invention. That is, rather than a conventional mop head comprising strands of 100% cotton material, strands of material comprising different blends of cotton and rayon or the like may be made available with the mop head of the present invention.

A central band 54 is attached at the area of the handle attachment 34 and may be used to cinch the strands 32 such that they correspond in width to conventional bail and shoe arrangements. The central band 54 advantageously can serve as a handle attachment region. It is apparent that additional bands can also be used to further secure the plurality of strands together. Other methods of attaching the strands, such as staples or glue, can also be used. In an alternative embodiment (not shown), the strands are held together at a single point that serves as handle attachment region, resulting in a cluster of strands emanating from the handle attachment region.

Figure 2:
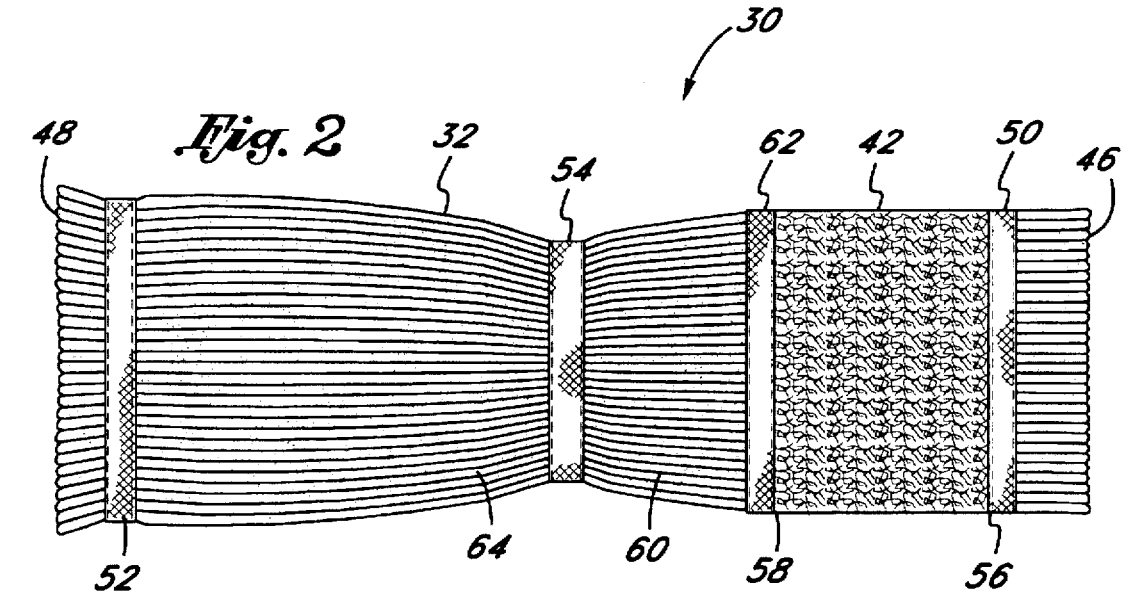
FIG. 2 is a top plan view of the preferred embodiment of FIG. 1, further illustrating the attachment of the abrasive pad.

As illustrated more clearly in FIG. 2, the abrasive pad 42 is attached near the free ends 46 of the plurality of strands 32 (to the right). The abrasive pad 42 may be comprised of any of a variety of abrasive materials including those sold under the following trademarks: "Superstrip" (Microton Abrasives), "Doodlebug" (3M), "Scotchbrite" (3M), "Razor Pad" (Etc. of Henderson Inc.) or "Tough Duty" (Kellogg Brush Manufacturing). The pad 42 is of a generally rectangular shape having a distal end 56 located closer to the first free ends 46 and a proximal end 58 located closer to the central band 54 at the handle attachment area. Advantageously, the pad 42 is positioned on the strands 32 so as to provide continuous contact with the surface of the floor during ordinary mopping. In one embodiment, the pad 42 has a square shape approximately 8 inch×8 inch (20 cm×20 cm), and extends substantially over the strands 32 on a first side 60 of the mop head 30. However, pads of various shapes can also be employed. The distal end 56 of the abrasive pad 42 is attached using the first end band 50 located at the first free ends 46. Although, a separate strip of material may alternately be used to attach the distal end 56 of the abrasive pad 42 to the strands 32. A fourth band 62 is preferably used to attach the proximal end 58 of the abrasive pad 42 to the strands 32. The band can also be attached through any of a variety of well known attachment techniques, including glue, staples, clips, etc. In the alternative embodiment, referred to above as having a cluster of strands emanating from the handle attachment region, the pad can be attached to any side of the strands.

Figure 3:
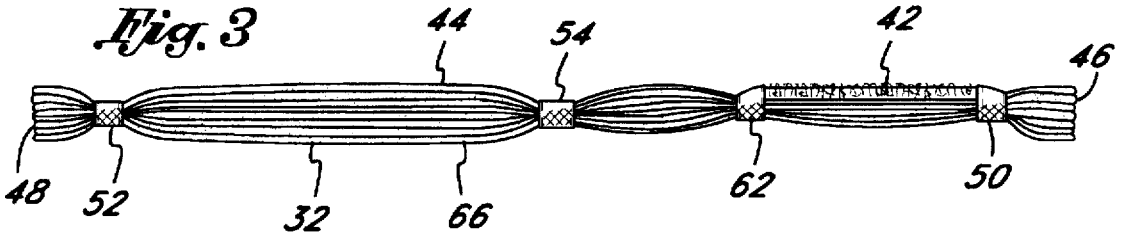
FIG. 3 is a side elevational view of the preferred embodiment of FIG. 1 and is a mirror image of the other side elevational view.

As further illustrated in FIG. 3, the abrasive pad 42 is generally located closer to the first free ends 46 of the top side 44 of the mop head 30 of the present invention. The distal end 56 of the abrasive pad 42 may be positioned from one-tenth to two-thirds the distance from the first free ends 46 to the central band 54. It can be seen in each of the figures that the pad of the embodiment depicted therein is attached to the strands 32 in a manner such that the distal end of the pad extends from approximately one-third to slightly more than three-fourths the distance from the mop handle attachment region to the ends of the plurality of absorbent strands 32. In alternative embodiments, one or more additional abrasive pads may be attached on a second side 64 close to the second free ends 48 (to the left in FIG. 2), and/or close to either/both free ends 46, 48 on a bottom side 66 of the mop head 30 illustrated in FIG. 6. Although, the attachment of more than two abrasive pads, if comprising a total area more than half the outer surface area of the mop head 30, may reduce the effectiveness of the combination of the plurality of strands 32 with the abrasive pad 42.

Figure 4:
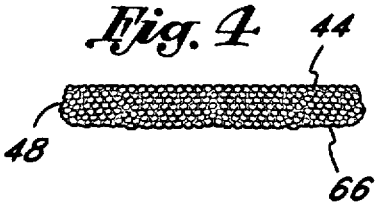
FIG. 4 is a left end view of the preferred embodiment illustrated in FIGS. 2–3.
Figure 5:
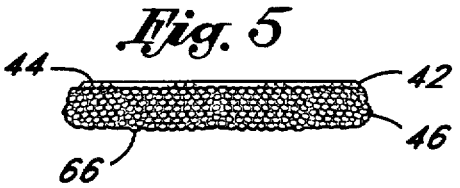
FIG. 5 is a right end view of the preferred embodiment illustrated in FIGS. 2–3.

FIGS. 4 and 5 illustrate the free ends 46, 48 of the plurality of strands 32, which are attached together to have a width much greater than its depth. The width, however, is easily received in conventional mop buckets and mop ringers.

Figure 6:
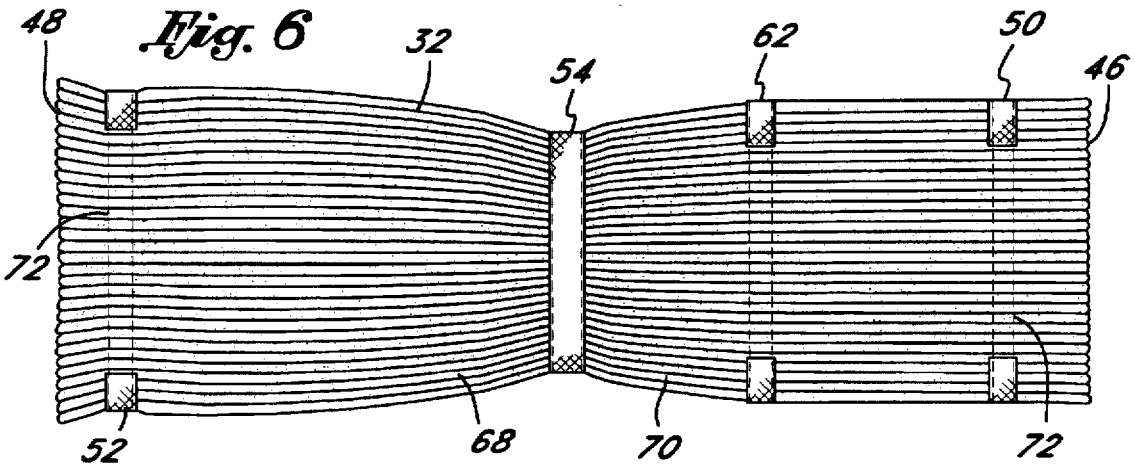
FIG. 6 is a bottom plan view of the embodiment.

FIG. 6 illustrates the bottom side 66 of the mop head 30, where left and right portions 68 and 70, respectively, face each other when the handle 38 is attached and the mop 40 is positioned vertically with the plurality of strands 32 folded in two. The attachment of the end bands 50, 52 and central band 54 to the strands 32 is preferably accomplished using laterally extending stitches 72. The end bands 50, 52 surround at least the top side 44 of the mop head 30; although, it is obvious to have the end bands 50, 52 further extend laterally to across the bottom side 66 of the mop head 30, just as the central band 54 does.

Figure 7:
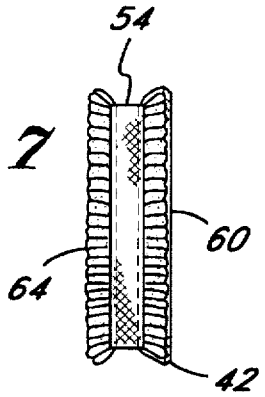
FIG. 7 is a top view of the preferred embodiment of FIG. 1 prior to attachment to a handle.
Figure 11:
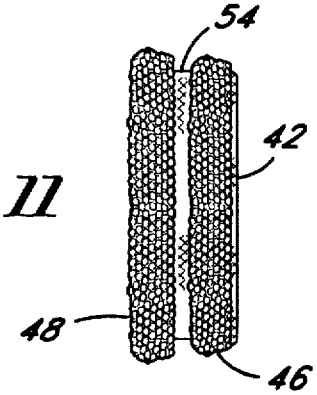
FIG. 11 is a bottom view of the preferred embodiment of FIG. 1 prior to attachment to a handle.

FIG. 7 illustrates a top view of the preferred embodiment of the mop head 30 of the present invention, and indicates the folded thickness of the mop head 30 with the abrasive pad 42 attached. The corresponding bottom view of the mop head 30 is illustrated in FIG. 11. Because of the material used and the preferred attachment to the mop head 30, the size and weight added by the abrasive pad 42 are fairly inconsequential in actual mopping use, described further below.

Figure 9:
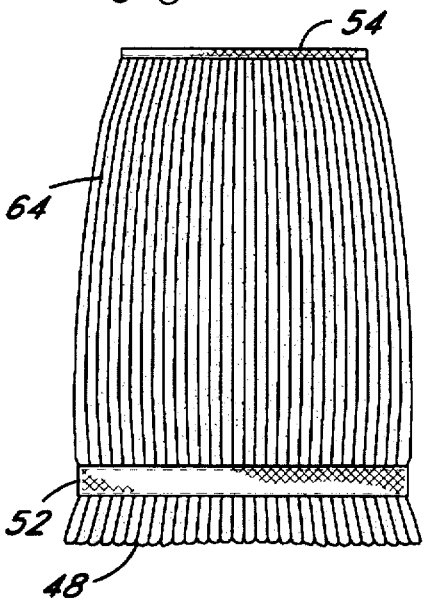
FIG. 9 is a left elevational view of the preferred embodiment as illustrated in FIG. 7.
Figure 8:
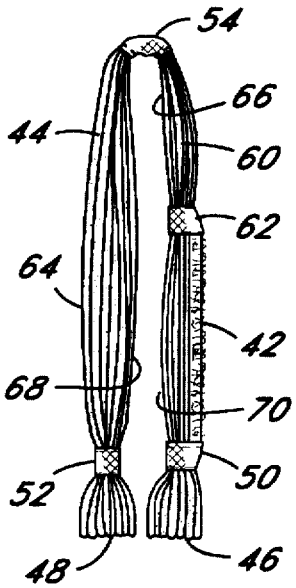
FIG. 8 is an end elevational view of the preferred embodiment of FIG. 1 prior to attachment to a handle and is a mirror image of the other end elevational view.
Figure 10:
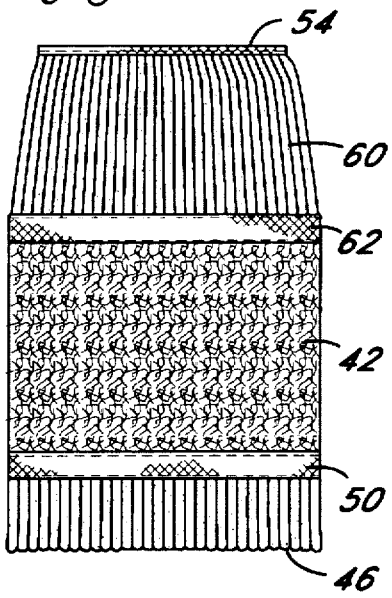
FIG. 10 is a right elevational view of the preferred embodiment as illustrated in FIG. 7.
Figure 12:
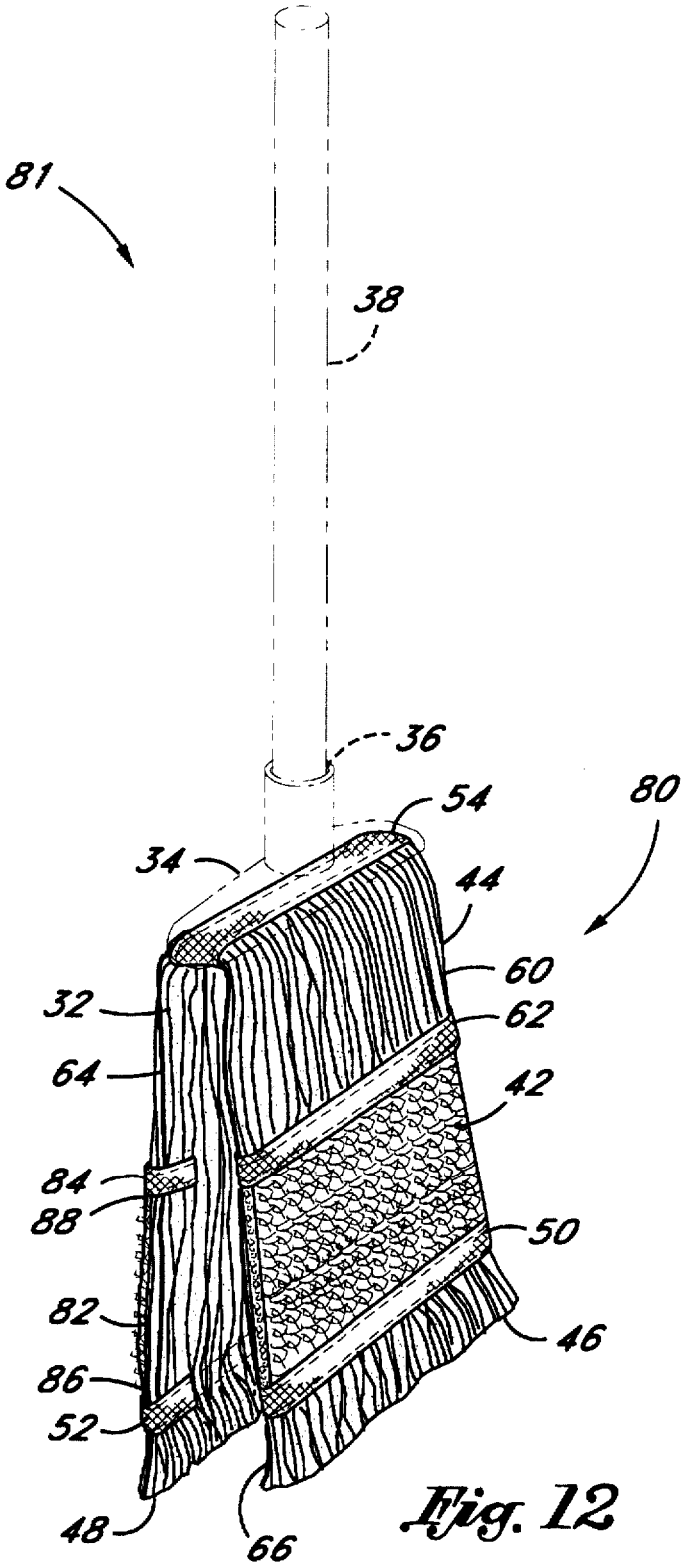
FIG. 12 is a perspective view of another preferred embodiment of the present invention, illustrating abrasive pads attached close to the end of both outer-facing sides of the mop head, with a mop handle attachment shown in phantom.

The side view of the mop head 30 in FIG. 3 is illustrated in a folded state in FIG. 8, wherein the outer-facing strand side 64 is further illustrated in FIG. 9 and the outer-facing abrasive pad side 60 is further illustrated in FIG. 10. As previously noted, an additional abrasive pad may be attached to the second side 64 of FIG. 9 such that a second preferred embodiment 80 is obtained, as shown in FIG. 12. Of course, in yet other, alternative embodiments supplementary pads may be attached to the remaining sides 68 and 70 near the free ends 46, 48 of the strands 32.

Referring to FIG. 12, a second preferred embodiment is shown wherein a mop head 80 is conventionally attached to a handle 38 to complete a mop 81. A second abrasive pad 82 is preferably similar in size and material to the first abrasive pad 42 of the previous embodiment which is attached to the first outer facing side 60 of the mop head 80. The second abrasive pad 82 is attached at the other outer facing side 64 of the mop head 80, near the second plurality of free ends 48 of the strands 32. The second abrasive pad 82 is attached at a distal end 86 by the second end band 52 and at a proximal end 88 by a fifth band 84. As discussed previously, the distal end 86 of the second abrasive pad 82 may be attached to the strands 32 using a separate strip of material. Alternatively, the proximal ends 58, 88 of the first and second abrasive pads 42, 82, respectively, may be left unattached to the plurality of strands 32. The additional embodiments shown in FIGS. 12–23 utilize the same reference numbers from FIGS. 1–11 when referring to similar elements.

In another preferred embodiment of FIG. 13, it is shown that an abrasive pad may be attached to the handle attachment region, in addition to a pad attached near the plurality of free ends of the strands 32 of material on a mop head 90 which is conventionally attached to a handle 38 to form a mop 91. Again, a central band 54 is attached at the area of the handle attachment 34 and may be used to cinch the strands 32 such that they correspond in width to conventional bail and shoe arrangements.

Figure 14:
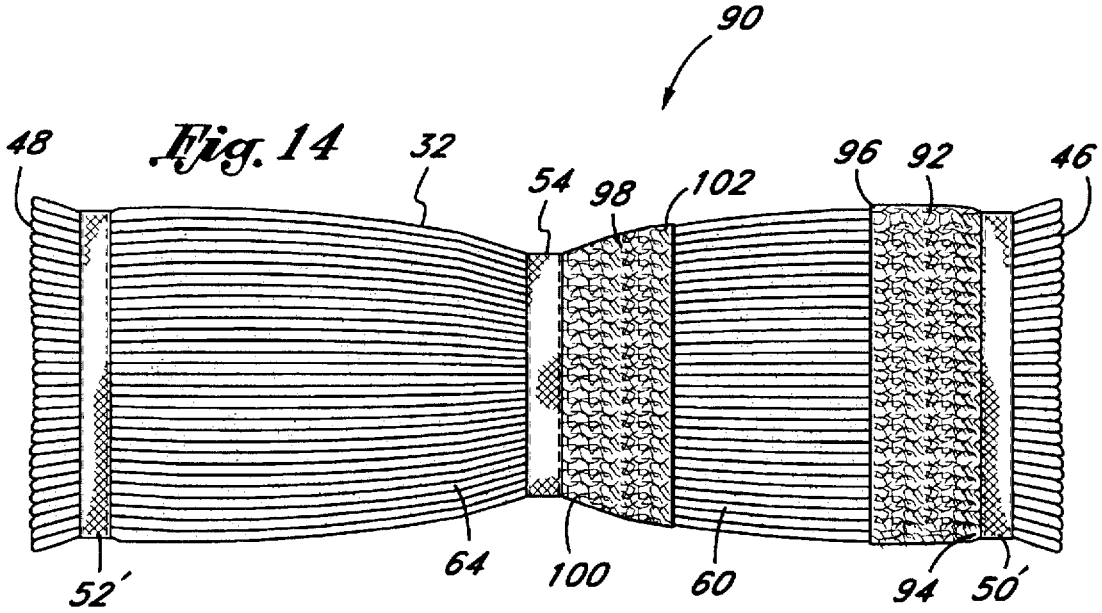
FIG. 14 is a top plan view of the preferred embodiment of FIG. 13, further illustrating the attachment of the abrasive pads.

As illustrated more clearly in FIG. 14, a first abrasive pad 92 is attached near the free ends 46 of the plurality of strands 32 (to the right). As before, the abrasive pad 92 may be comprised of any of a variety of abrasive materials including those sold under the trademarks such as "Superstrip", "Doodlebug", "Scotchbrite", etc., and the pad 92 is preferably of a generally rectangular shape having a distal end 94 located closer to the first free ends 46 and a proximal end 96 located closer to the central band 54 at the handle attachment area. Advantageously, the pad 92 is positioned on the strands 32 so as to provide continuous contact with the surface of the floor during ordinary mopping.

Figure 15:
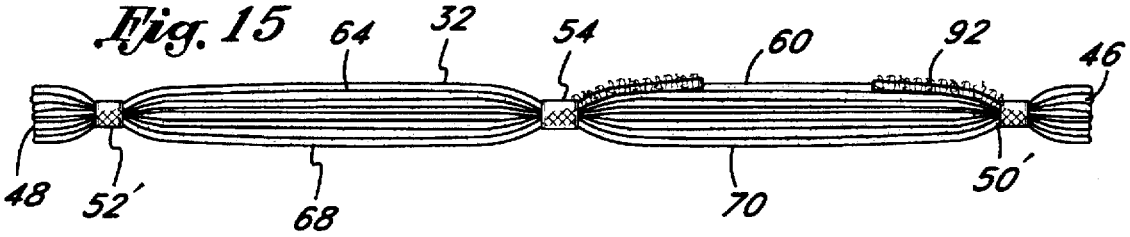
FIG. 15 is a side elevational view of the preferred embodiment of FIG. 13 and is a mirror image of the other side elevational view.

The distal end 94 of the first abrasive pad 92 is attached using a first end band 50' located at the first free ends 46. Although, a separate strip of material may alternately be used to attach the distal end 94 of the abrasive pad 92 to the strands 32. Referring to FIGS. 15 and 18, the proximal end 96 of the abrasive pad 92 is not attached to the strands 32. In the embodiment of FIGS. 13–23, the mop head 90 is shown with its end bands 50' and 52' comprising strips of absorbent material extending laterally around the outer sides 44 and inner sides 66 of the mop head 90. However, the mop head 90 in alternative embodiments may have end bands 50, 52, as in the previously described embodiments, extending only across the outer sides 44.

Referring to FIG. 14, a second abrasive pad 98 of this embodiment is attached between the proximal end 96 of the first abrasive pad 92 and the handle 38. This second abrasive pad 98 is preferably of stronger material than the first abrasive pad 92 because of its location at the handle attachment region, since it is expected that this second pad 98 will be subjected to greater forces during mopping. The size of the second abrasive pad 98 is generally somewhat larger than the first pad 92; although, in alternative embodiments, the reverse may be true or the two abrasive pads may be identical in size as well as material, without loss of advantage from the present invention. The first and second abrasive pads 92, 98 may be of two different colors denoting a difference in material for replacement purposes.

Preferably, a distal end 102 of the second pad 98 is not attached to the strands 32, while a proximal end 100 of the second pad 98 is attached using the central band 54. Although, the second pad 98 may be attached at its proximal end 100 by a separate strip of material or other attachment techniques, such as staples, clips, etc. Not attaching the proximal and distal ends 96, 102 of the first and second abrasive pads 92, 98, respectively, allows the mopping strokes to be completed without "bunching" of the ends 94, 96 and 100, 102 of the pads 92 and 98. That is, it has been observed that the lengths of the strands of material 32 located below the pads 92, 98 have a tendency to bunch up as the pads' ends are pushed together during each mopping stroke and as contact of the pads with the floor is reduced. Attaching only one end of each pad allows each pad to flip over and otherwise move freely during the mopping action.

In an especially preferred embodiment, the pad 98 is attached to the mop head attachment region 34 at a proximal end 100 thereof. In this embodiment, the other, distal end 102 of the pad 98 extends more than 3½ inches from the mop head attachment region 34 more preferably the distal end extends at least 4 inches from the mop head attachment region, still more preferably at least 5 inches, even more preferably at least 6 inches, yet more preferably at least 7 inches, more preferably still at least 8 inches, and most preferably at least 9 inches. The distal end of the pad 98 can extend as long as the length of the plurality of strands. The width and shape of the pad 98 of this embodiment can be adapted for many different configurations; however, the preferred pad is rectangular and approximately 6 to 9 inches wide. Advantageously, when using the pad 98 of the present invention which extends more than 3½ inches from the mop head attachment region 34, the distal end 102 of the pad 98 will catch the floor during a normal mopping stroke such that the pad will provide substantially constant contact with the floor during ordinary mopping. Thus, the pad 98 will provide for abrasive point load mopping during ordinary use of the mop without need for any special skills or training. Of course, the distal end 102 of the pad 98 can be sewn to the plurality of strands 32. However, in this embodiment of the invention, sewing the distal end 102 increases the costs of production for little advantage. Additionally, this embodiment of the mop head 90 can be used with or without the other pad 92.

Again, it can be seen in FIGS. 13–23 that the abrasive pads 92, 98 are each attached to the plurality of strands 32 in a manner such that the distal end of either pad extends from between one-third to slightly more than three-fourths the distance from the mop handle attachment region to the ends of the plurality of absorbent strands 32. In alternative embodiments, one or more additional abrasive pads may be attached to the remaining sides 68, 70, close to either/both free ends 46, 48 of the mops head 90.

Figure 16:
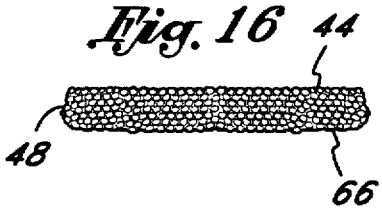
FIG. 16 is a left end view of the preferred embodiment illustrated in FIGS. 14–15.
Figure 17:
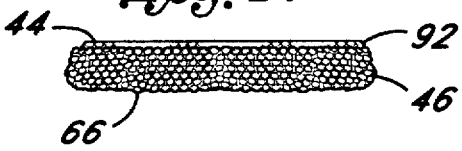
FIG. 17 is a right end view of the preferred embodiment illustrated in FIGS. 14–15.
Figure 18:
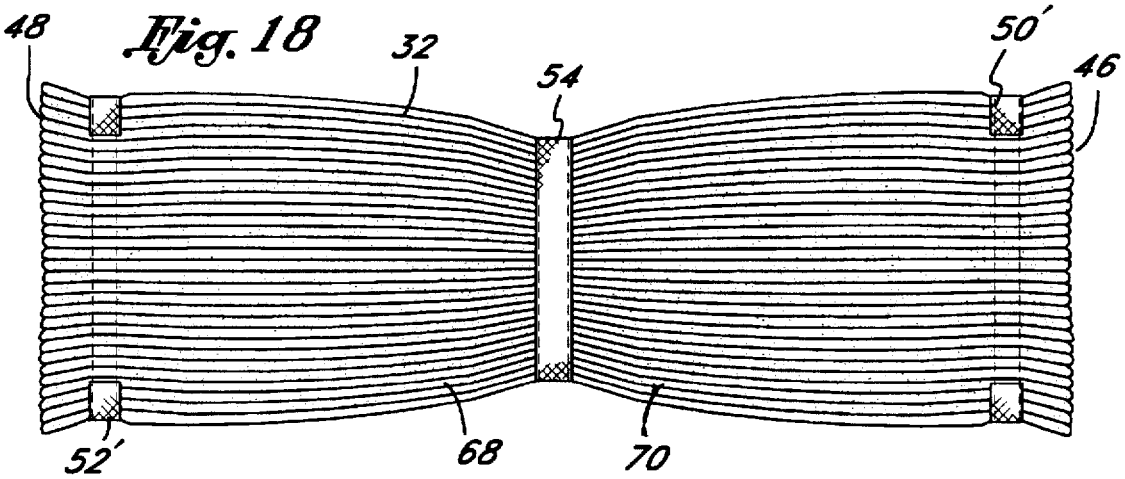
FIG. 18 is a bottom plan view of the embodiment.

FIGS. 16 and 17 illustrate the free ends 46, 48 of the plurality of strands 32, which are attached together to have a width much greater than its depth. The width, however, is easily received in conventional mop buckets and mop ringers.

Figure 19:
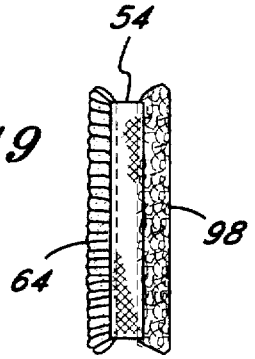
FIG. 19 is a top view of the preferred embodiment of FIG. 13 prior to attachment to a handle.
Figure 23:
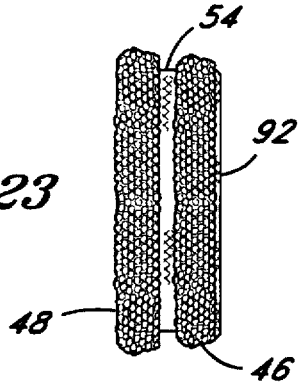
FIG. 23 is a bottom view of the preferred embodiment of FIG. 13 prior to attachment to a handle.

FIG. 19 illustrates a top view of the preferred embodiment of the mop head 90 of the present invention, and indicates the folded thickness of the mop head 90 with the abrasive pads 92, 98 attached. The corresponding bottom view of the mop head 90 is illustrated in FIG. 23. Because of the material used and the preferred attachment to the mop head 90, the size and weight added by the abrasive pads 92, 98 are still fairly inconsequential in comparison with the wetted mop head 90 in actual mopping use, described further below.

Figure 21:
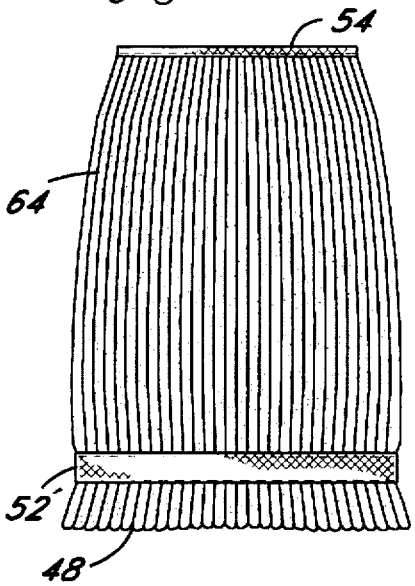
FIG. 21 is a left elevational view of the preferred embodiment as illustrated in FIG. 19.
Figure 20:
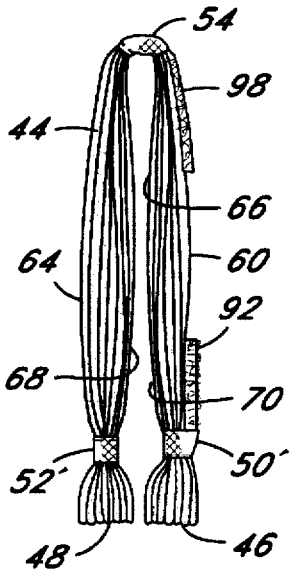
FIG. 20 is an end elevational view of the preferred embodiment of FIG. 13 prior to attachment to a handle and is a mirror image of the other end elevational view.
Figure 22:
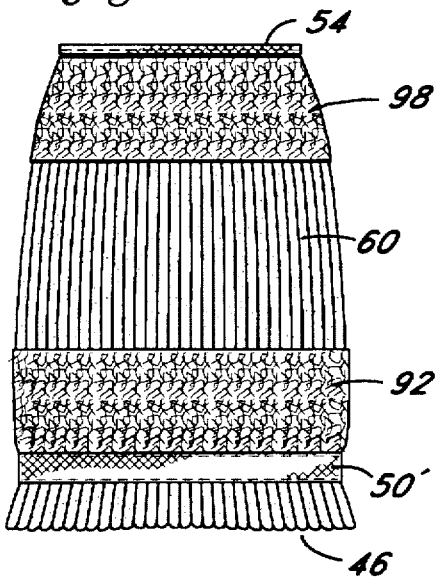
FIG. 22 is a right elevational view of the preferred embodiment as illustrated in FIG. 19.

The side view of the mop head 10 in FIG. 15 is illustrated in a folded state in FIG. 20, wherein the outer-facing strand side 64 is further illustrated in FIG. 21 and the outer-facing abrasive pad side 60 is further illustrated in FIG. 22. FIG. 23 is a bottom view of the folded mop head 90 and corresponds to FIGS. 16 and 17.

Preferred Method of Mopping

The mop heads 30, 80, 90 of the present invention allow a popular, economical cleaning method to be used with greatly increased efficiency in the removal of typical surface contaminants. The process of mechanically breaking up the polymerized bonds is easily accomplished using traditional, well known mopping action, eliminating any need for specialized training in the use of any of the mop heads 30, 80, 90 of the present invention. And, any existing supply of cleaning solutions, including detergents, and buckets may be utilized, resulting in added economy.

The mopping operation preferably comprises the simple steps of (a) wetting the mop head in cleaning solution, (b) applying a first side 60 of the mop head to the floor in a normal manner, (c) applying a second side 64 of the mop head to the floor in a normal manner, (d) rinsing the mop head in cleaning solution, and (e) squeezing out the contaminants which have been removed by the mop head. The process is repeated as needed to cover the entire floor area.

For the mop head 30, 90 of the first and third preferred embodiments, the first side 60 includes the abrasive pad(s) 42, 92, which provide the aggressively abrasive action to break up the contaminants. The second side 64 is the strand-only side, which serves to extract the broken up contaminants from the floor surface.

For the mop head 80 of the second preferred embodiment, both outer sides 44 provide aggressive abrasive action to break up the contaminants. For this second embodiment, the upper portions of the outer facing sides 44 of the mop head 80, and the inner sides 66 of the mop head 80, may be maneuvered to extract the broken up contaminants from the floor surface after application of the padded sides 60, 64.

For the places where stains, or concentrations of contaminants, have formed on the floor, the abrasive pad(s) near the free ends 46, 48 may be employed to provide added scrubbing action to break up the stain for removal. That is, for step (b) above, the abrasive pad 42/82/92 of the wetted mop head 30/80/90 may be placed over the stain and the end 36 of the mop handle 38 may be placed over the abrasive pad 42/82/92. Pressure is then applied to the handle 38 in strokes to scrub the stain. Removal of the broken up stain is then accomplished following steps (c)–(e).

Thus, the mop head of the present invention greatly improves upon traditional mopping techniques to mechanically break up surface contaminants which are then easily removed. The coefficient of friction of the floor is restored to a much safer level without harm to the floor material. And, economy is achieved by the use of available cleaning supplies and the fact that no special training is required in its use.

Other changes and modifications may be made from the embodiments presented herein by those skilled in the art without departure from the spirit and scope of the invention, as defined by the appended claims.

What is claimed is:

1. A mop head that removes grease load and increases the coefficient of friction of a floor by abrasive point load mopping, comprising:

a plurality of elongated strands of absorbent material having a first plurality of free ends and a second plurality of free ends;

a mop handle attachment region located intermediate said first plurality of free ends and said second plurality of free ends, said mop handle attachment region adapted to attach to a mop handle;

a first abrasive pad having a distal end and a proximal end, said first pad attached to said strands intermediate said first plurality of free ends and said handle attachment region, said distal end of said first pad closer to said first plurality of free ends and said proximal end of said first pad closer to, yet spaced away from, said handle attachment region; and at least one additional abrasive pad having a proximal end and a distal end, said distal end of said additional pad intermediate said proximal end of said first pad and said handle attachment region.

2. The mop head of claim 1, wherein said distal end of said first pad is positioned in the range from approximately one-tenth the distance from said first plurality of free ends to said handle attachment region and two-thirds the distance from said first plurality of free ends to said handle attachment region.

3. The mop head of claim 1, further comprising at least one band for fastening said strands of absorbent material together.

4. The mop head of claim 3, comprising at least three bands for fastening said strands of absorbent material together, as follows: a central band at said handle attachment region, a first end band located between said handle attachment region and said first plurality of free ends, and a second end band located between said handle attachment region and said second plurality of free ends.

5. The mop head of claim 4, wherein said distal end of said first pad is attached to said strands of absorbent material by said first end band.

6. The mop head of claim 1, wherein said first abrasive pad is comprised of a non-absorbent material.

7. The mop head of claim 6, wherein said first abrasive pad is porous.

8. The mop head of claim 3, wherein each of said bands is formed of a strip of absorbent material stitched onto said strands of absorbent material.

9. The mop head of claim 8, wherein each of said strips of absorbent material extends laterally across at least one side of said strands of absorbent material.

10. The mop head of claim 1, wherein said proximal end of said additional pad is attached at said handle attachment region.

11. The mop head of claim 10, wherein said first pad attached nearer said first plurality of free ends is attached to said strands along its distal end, wherein said proximal end of said first pad and said distal end of said additional pad are separable from said strands.

12. The mop head of claim 1, wherein said first pad extends laterally across all of said strands.

13. The mop head of claim 1, wherein said first abrasive pad is rectangular strands.

14. A mop head for abrasive point load mopping of a floor, comprising:

a plurality of elongated strands of absorbent material having a plurality of free ends;

a mop handle attachment region on said strands, said handle attachment region adapted to attach to a mop handle;

a first abrasive pad attached to said strands intermediate said plurality of free ends and said handle attachment region; and a second abrasive pad attached to said strands between said first abrasive pad and said mop handle attachment region, wherein said first and second abrasive pads are applied with said strands to be in continuous contact with floor during said abrasive point load mopping thereof.

15. An abrasive mop head for cleaning a floor having contaminants thereon, said mop head comprising:

a plurality of elongated strands of absorbent material having a first plurality of free ends and a second plurality of free ends;

a mop handle attachment region located intermediate said first plurality of free ends and said second plurality of free ends;

a first abrasive pad attached directly to said strands, said pad having a distal end and a proximal end, said distal end being closer to said first plurality of free ends than said second plurality of free ends, said distal end extending at least one-third the distance from said handle attachment region to said first plurality of free ends; and a second abrasive pad having a distal end and a proximal end, said second abrasive pad attached to said strands intermediate said mop handle attachment region and said proximal end of said first abrasive pad, such that said first and second abrasive pads are simultaneously applied to the floor with said strands, said first and second abrasive pads in continuous contact with the floor during each mopping stroke.

16. The mop head of claim 15, wherein said proximal end of said first pad and said distal end of said second pad are unattached to said strands of absorbent material.

17. An abrasive mop head that removes grease load and increases the coefficient of friction of a dirty floor by abrasive point load mopping, comprising:

a plurality of elongated strands of absorbent material having a first plurality of free ends and a second plurality of free ends;

a mop handle attachment region located intermediate said first plurality of free ends and said second plurality of free ends, said mop head attachment region adapted to attach to a mop handle; and an abrasive pad having a planar surface, said planar surface of said pad being substantially parallel to a surface formed by said elongated strands, having a distal end and a proximal end, said proximal end of said pad sewn to said mop head attachment region, and said distal end of said pad extending more than 3.5 inches from said mop head attachment region.

* * * * *